US009295612B2

(12) United States Patent
Lawyer et al.

(10) Patent No.: US 9,295,612 B2
(45) **Date of Patent: *Mar. 29, 2016**

(54) FOOT SPA TUB PUMP AND METHOD

(75) Inventors: Justin Lawyer, Tulsa, OK (US); Patrick Clasen, Kirkwood, MO (US); Timothy Marks, Scarsdale, NY (US); Quy Ton, Baton Rouge, LA (US)

(73) Assignee: Ecotech Marine, LLC, Allentown, PA (US)

( * ) Notice: Subject to any disclaimer, the term of this patent is extended or adjusted under 35 U.S.C. 154(b) by 932 days.

This patent is subject to a terminal disclaimer.

(21) Appl. No.: 13/545,516

(22) Filed: Jul. 10, 2012

(65) Prior Publication Data

US 2012/0272446 A1 Nov. 1, 2012

Related U.S. Application Data

(63) Continuation of application No. 12/189,365, filed on Aug. 11, 2008, now Pat. No. 8,214,937.

(60) Provisional application No. 60/955,036, filed on Aug. 9, 2007, provisional application No. 61/021,386, filed on Jan. 16, 2008.

(51) Int. Cl.

| | |
|---|---|
| ***A47K 3/00*** | (2006.01) |
| ***A61H 35/00*** | (2006.01) |
| ***A61H 33/00*** | (2006.01) |

(52) U.S. Cl.

CPC ..... *A61H 35/006* (2013.01); *A61H 33/6021* (2013.01); *A61H 33/6063* (2013.01); *A61H 33/0087* (2013.01); *A61H 2201/0176* (2013.01); *A61H 2201/1207* (2013.01)

(58) Field of Classification Search

CPC ..... A61H 33/0091; A61H 33/0087
USPC ..... 4/541.1–541.6
See application file for complete search history.

(56) References Cited

U.S. PATENT DOCUMENTS

| | | | |
|---|---|---|---|
| 2,506,886 | A | 4/1948 | Zozulin et al. |
| 3,089,514 | A | 5/1963 | Sudmeier |
| 3,198,125 | A | 8/1965 | Yuza et al. |
| 3,297,025 | A | 1/1967 | Jacuzzi |
| 3,321,081 | A | 5/1967 | Willinger |
| 3,420,184 | A | 1/1969 | Englesberg et al. |
| 3,481,586 | A | 12/1969 | Roberts |

(Continued)

FOREIGN PATENT DOCUMENTS

| | | | |
|---|---|---|---|
| EP | 0401761 | A2 | 12/1990 |
| EP | 0665024 | A1 | 8/1995 |

(Continued)

*Primary Examiner* — Huyen Le
(74) *Attorney, Agent, or Firm* — Berenato & White, LLC

(57) ABSTRACT

A foot spa tub includes a tub basin, a first magnetic drive member rotatably coupled to a drive motor, and a first casing supporting the magnetic drive member. The first casing is disposed against an exterior surface of a sidewall of the basin. A second magnetic drive member is rotatably coupled to a blade. The first and second magnetic drive members are magnetically coupled to each other so that the blade is drivingly coupled to the drive motor. A nozzle houses the second magnetic drive member and the blade. The nozzle is detachably securable to an interior surface of the sidewall by a magnetic attraction force between the first and second magnetic drive members. A method of circulating liquid in a foot tub spa is also provided.

17 Claims, 12 Drawing Sheets

(56) References Cited

U.S. PATENT DOCUMENTS

| | | | | |
|---|---|---|---|---|
| 3,512,646 | A | 5/1970 | Willinger | |
| 3,516,543 | A | 6/1970 | Willinger | |
| 4,024,064 | A | 5/1977 | Rakowicz et al. | |
| 4,226,574 | A | 10/1980 | Villette | |
| 4,901,379 | A | 2/1990 | Chalberg et al. | |
| 4,982,461 | A | 1/1991 | Mikiya et al. | |
| 4,998,863 | A | 3/1991 | Klaus | |
| 5,269,664 | A | 12/1993 | Buse | |
| 6,447,027 | B1 | 9/2002 | Lilley et al. | |
| 6,751,814 | B2 | 6/2004 | Mattson, Jr. et al. | |
| 7,249,571 | B2 | 7/2007 | Allis | |
| 7,393,188 | B2 | 7/2008 | Lawyer et al. | |
| 7,744,355 | B2 | 6/2010 | Costa | |
| 8,607,374 | B2 * | 12/2013 | Lawyer et al. | 4/541.1 |
| 8,944,786 | B1 | 2/2015 | McDougall | |
| 2002/0097372 | A1 | 7/2002 | Zelman | |
| 2004/0018104 | A1 | 1/2004 | Watkins | |
| 2005/0120473 | A1 | 6/2005 | Southon et al. | |
| 2006/0013714 | A1 | 1/2006 | Wu | |
| 2006/0057006 | A1 | 3/2006 | Williams et al. | |
| 2006/0210412 | A1 | 9/2006 | Lawyer et al. | |
| 2006/0242760 | A1 * | 11/2006 | Chao | 4/622 |
| 2007/0136943 | A1 | 6/2007 | Long | |
| 2011/0138530 | A1 * | 6/2011 | Johnson | 4/541.6 |

FOREIGN PATENT DOCUMENTS

| | | | |
|---|---|---|---|
| GB | 2215599 | A | 9/1989 |
| WO | 99/08366 | A1 | 2/1999 |
| WO | 2006/101976 | A2 | 9/2006 |
| WO | 2009/020633 | A1 | 2/2009 |

* cited by examiner

FOOT SPA TUB PUMP AND METHOD

This application is a continuation of application Ser No. 12/189,365, filed on Aug. 11, 2008, now U.S. Pat. No. 8,214,937, which claim the benefit of priority to provisional application Ser No. 60/955,036, filed Aug. 9, 2007, and provisional application Ser No. 61/021,386, filed Jan. 16, 2008, the disclosures of which are incorporated herein by reference and to which priority is claimed.

TECHNICAL FIELD

The present invention is directed to a foot spa tub having a magnetic pump apparatus. First and second magnetic drive members are provided, which are magnetically coupled to each other so that a rotatable blade for circulating liquids is drivingly coupled to a drive motor. The present invention also relates to a method of circulating liquids in a spa tub.

BACKGROUND

In the nail salon industry, foot spa tubs are utilized on a daily basis. Customers sit in a chair, place their feet in a tub of liquid (e.g. water and optionally aromatic, therapeutic, or hygienic ingredients). This liquid is circulated in the tub with a pump for a period of time, after which the customer's feet are massaged, nails clipped, etc. After customer service is complete, the pump is disassembled from the tub, and the pump and tub are sanitized.

Conventional foot spa tubs include a system to circulate water in the tub basin. Such systems typically provide for one or more motors mounted on an exterior wall of the tub basin. Each motor is coupled to an impeller via a shaft, which extends through an opening provided in the basin sidewall. Intakes for the impeller are typically oriented such that water is drawn in axially, around the perimeter of the output, and then output axially as well. The water is retained in the basin by using a seal about the motor shaft. However, such designs are prone to water leakage around the shaft. The resulting leak results in water entering the motor area, which may cause motor failure and possibly electrical current flowing back into the basin, rendering the spa inoperable. In addition, such designs are prone to accumulation of dirt, mold and bacteria, and are difficult to clean and sterilize after use by each customer.

SUMMARY

The present invention is directed to a foot spa tub having a tub basin. A first magnetic drive member is provided, which is spaced from and rotatably coupled to a drive motor. A first casing supports the magnetic drive member, and is disposed against an exterior surface of a sidewall of the basin. A second magnetic drive member is provided, which is coupled to a blade which rotates in response to rotation of the second magnetic drive member. The first and second magnetic drive members are magnetically coupled to each other so that the blade is drivingly coupled to the drive motor. A nozzle is provided, which houses the second magnetic drive member and the blade. The nozzle is detachably securable to an interior surface of the sidewall by a magnetic attraction force between the first and second magnetic drive members.

The present invention also relates to a method of circulating liquid in a foot spa tub. A first casing is provided, which preferably is made from a polymer material, and which has a first magnetic drive member rotatably coupled to a source of rotary motion, such as an electric motor. A nozzle is provided which houses a blade coupled to a second magnetic drive member. A basin containing a liquid is provided. The first casing is positioned on an exterior surface of the basin. The nozzle is positioned on an interior surface of the basin so that the blade is within the liquid, and the first magnetic drive member rotates about an axis coaxial to an axis of rotation of the second magnetic drive member. The first casing and the nozzle remain in alignment as a result of a magnetic attraction force between the first and second magnetic drive members. The source of rotary motion is actuated, thereby causing the first magnetic drive member to rotate, which in turn causes rotation of the second magnetic drive member and of the blade.

BRIEF DESCRIPTION

DETAILED DESCRIPTION OF DRAWINGS

Figure 1:
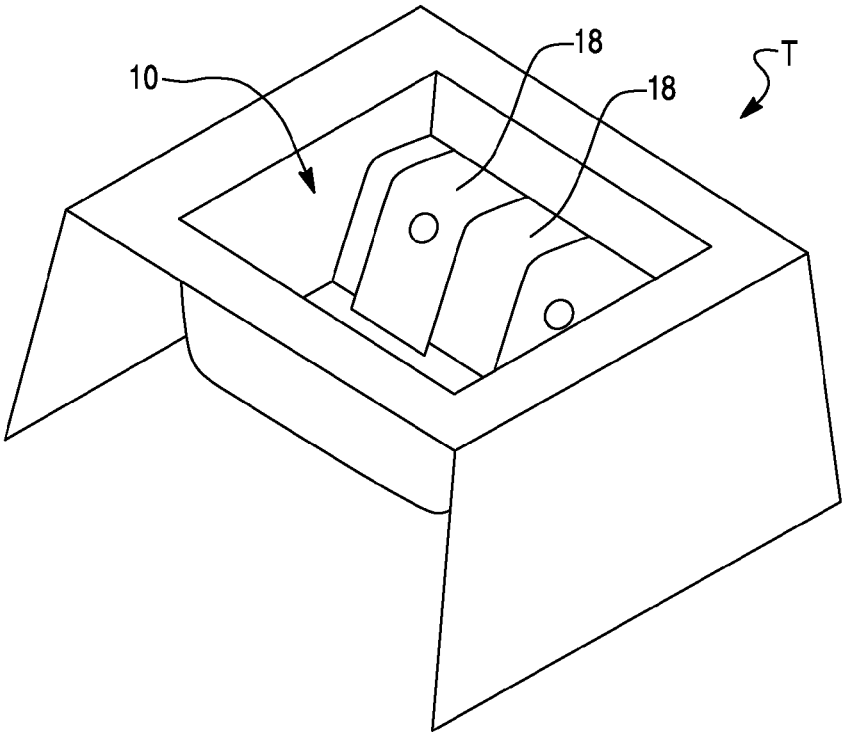
FIG. 1 is a perspective view of an exemplary foot spa tub according to an embodiment of the present invention.
Figure 2:
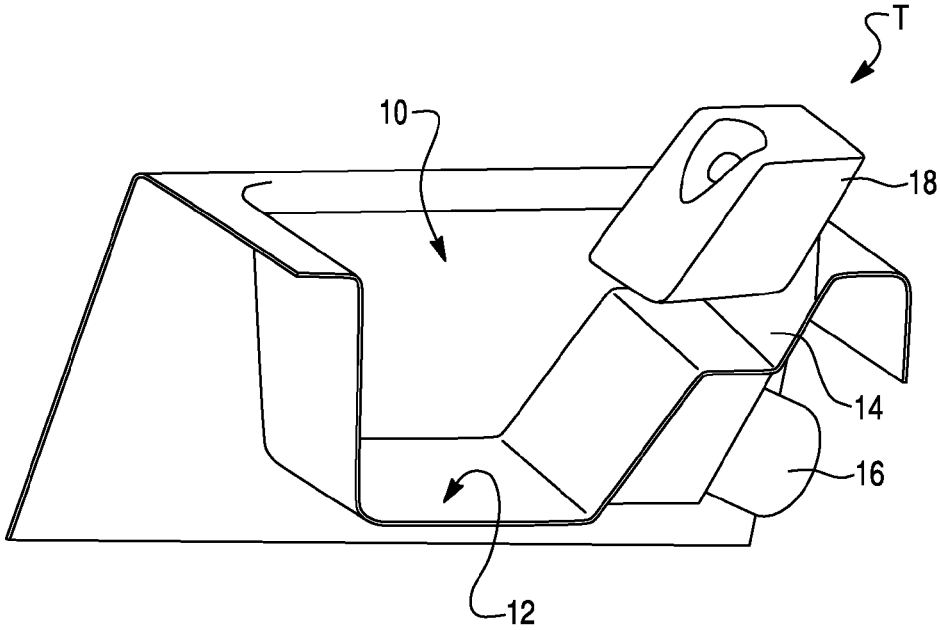
FIG. 2 is a sectional perspective view of the foot spa tub shown in FIG. 1.

An exemplary foot spa tub T according to an embodiment of the present invention is best shown in FIGS. 1 and 2. Spa tub T includes a basin 10 having a base 12 and sidewall 14 for containing a liquid, such as water and optionally aromatic, therapeutic, or hygienic ingredients. The tub T preferably has a drain allowing the liquid to be removed from the tub T and a faucet in operable association with the tub T to permit the tub T to be filled with liquid. One or more magnetic spa pumps are provided for circulating the liquid within basin 10, each pump including a mechanical driving mechanism 16 and a fluid pumping mechanism 18. Note that the specific configuration of driving mechanism 16 and pumping mechanism 18 may vary depending upon the configuration of basin 10. Thus, pumping mechanism 18 is shown in FIGS. 1 and 2 to have a generally rectangular configuration for purposes of explanation only.

Magnetic pump assemblies are known in the aquarium industry but the demands for an aquarium pump differ from those of a spa pump. The spa pump should be removed from operation between uses, where uses are periods of operation while servicing a pedicure client. It is necessary to sanitize the wetted components between clients. A spa pump should direct the liquid towards the feet of the client, preferably with a split flow so that each foot is massaged. Also, a safety shutoff should be provided so that the pump will not operate unless fully assembled.

Figure 2A:
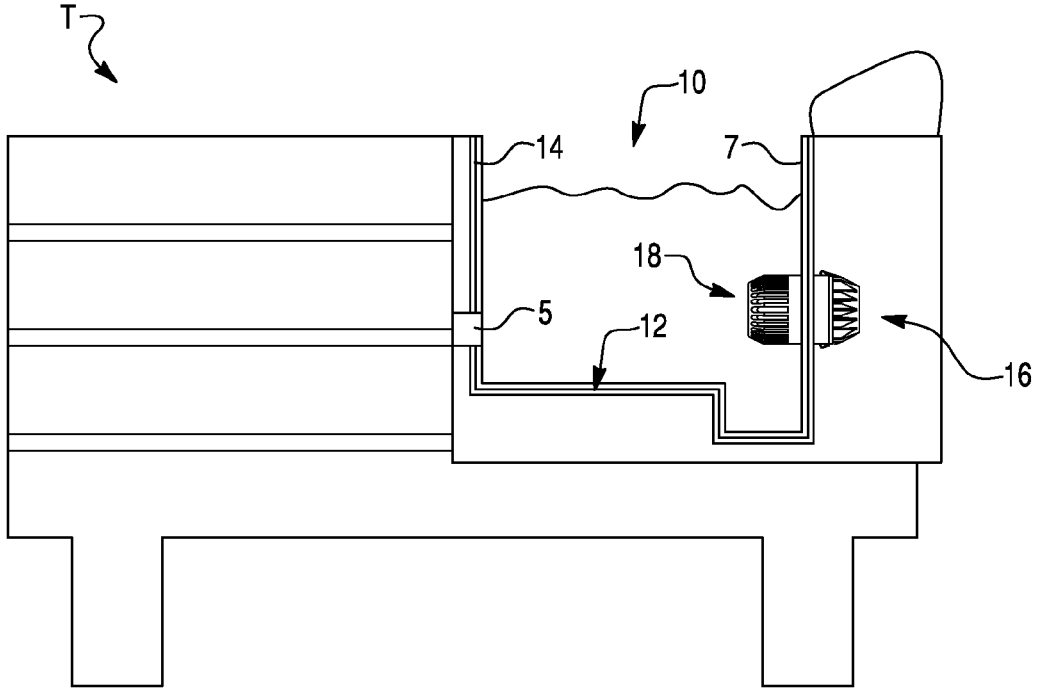
FIG. 2A is sectional view of an exemplary foot spa tub having another configuration according to the present invention.

In addition, the specific configuration of the spa tub T and basin 10 may vary, and the present invention is not limited to the exemplary configuration shown in FIGS. 1 and 2. For example, spa tub T may have a generally rectangular configuration different than that shown in FIGS. 1 and 2, as shown in FIG. 2A. Exemplary configurations of driving mechanism 16 and pumping mechanism 18 are also shown. Note that driving mechanism 16 and pumping mechanism 18 are secured to opposing sides of a substantially planar sidewall 14. Spa tub T may include an associated light 5 embedded in or behind sidewall 14. The basin 10 preferably is manufactured from a polymer material and is relatively thin in wall thickness to reduce weight, minimize amount of polymer, and may have a handle or overturned top edge to permit basin 10 to be carried easily.

Figure 3:
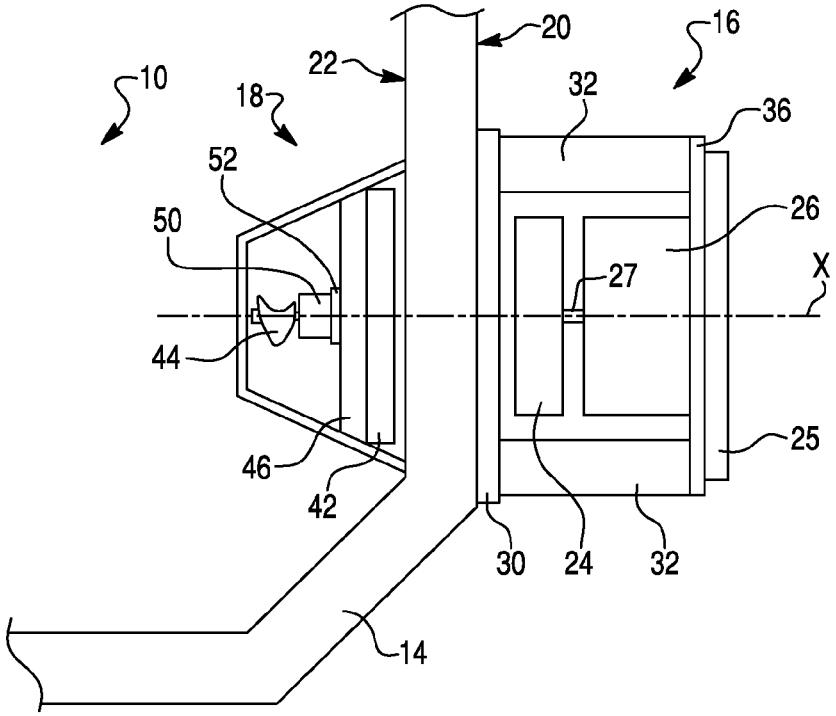
FIG. 3 is a fragmentary sectional view of a foot spa tub according to the present invention, showing a portion of the basin, and the driving and pumping mechanisms.

As best shown in FIG. 3, driving mechanism 16 is preferably permanently or semi-permanently affixed to an exterior surface 20 of sidewall 14 with mechanical fasteners, adhesive, a flexible cord, or the like. Pumping mechanism 18 is detachably securable to an interior surface 22 of sidewall 14, so that pumping mechanism 18 may be immersed in the liquid within basin 10. Pumping mechanism 18 is aligned with and magnetically coupled to driving mechanism 16 via a magnetic attraction force, which is sufficiently strong to hold pumping mechanism 18 in a desired position against interior surface 22 during operation of foot spa tub T. Thus, driving mechanism 16 and pumping mechanism 18 are separated by thin, plastic sidewall 14. Pumping mechanism 18 may be easily detached and removed from sidewall 14 of basin 10 for cleaning and maintenance and for allowing the interior of basin 10 to be sanitized between uses. Driving mechanism 16 remains attached to sidewall 14, however. Because driving mechanism 16 and pumping mechanism are magnetically secured, the pumping mechanism 18 may be easily removed from basin 10 after the customer session. Because of a safety switch activated when the mechanisms are not connected, driving mechanism 16 will not operate during sanitizing of basin 10.

As best shown in FIGS. 4-7, driving mechanism 16 comprises a first magnetic drive member 24 drivingly coupled to a drive motor 26. First magnetic drive member 24 is rotatable about an axis X via rotation of a motor shaft 27 associated with drive motor 26, as shown in FIG. 3.

First magnetic drive member 24 has a multi-pole configuration, with at least one pair of magnetic poles (N) and (S). Preferably, first magnetic drive member 24 is in the form of a circular disk having a plurality of pairs of magnetic poles (N) and (S). In such an arrangement, the magnetic poles (N) and (S) are oriented in a two-dimensional array. The poles are arranged in an equal and opposite fashion, and are arrayed in a radial pattern around the axis X of rotation. First magnetic drive member 24 may be formed from neodymium or any other high performance magnetic material offering low physical volume and high magnetic flux.

Drive motor 26 may be of any appropriate type, such as hydraulic, electric, etc. Preferably, drive motor 26 is an electric motor (either AC motor or DC motor). For this reason, covers made of magnetically permeable material, such as steel, may be attached to and cover opposite ends of drive motor 26 to shield drive motor 26 from magnetic flux. In a preferred embodiment, drive motor 26 is a brushless DC motor driven by a motor driver 25, which is coupled to drive motor 26 via associated wires 29. In the case of an AC motor, motor driver 25 is not necessary.

Figure 14:
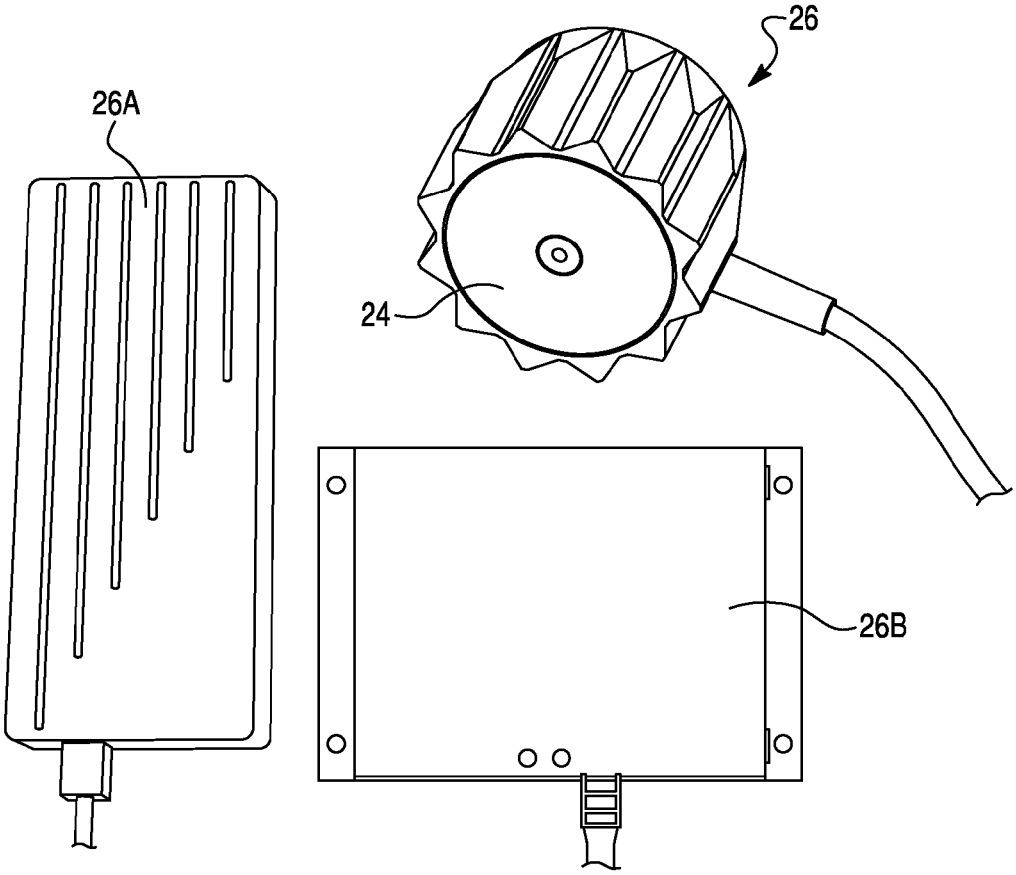
FIG. 14 is a perspective view of a driving mechanism, transformer and control circuit according to the present invention.

Drive motor 26 may be attached to a power source through associated wires, or may be powered by a battery (not shown) attached to electric wires. A control mechanism, such as an air pump, electrical switch, or the like, may be provided for controlling the power supply. As best shown in FIG. 14, a transformer 26A and control circuit 26B may be associated with drive motor 26, whereby transformer 26A is connected to a power source and powers control circuit 26B. Control circuit 26B, in turn, controls operation of drive motor 26. For example, control circuit 26B may control and adjust the rotational speed of drive motor 26 and thus the first magnetic drive member 24. Alternatively or in addition, control circuit 26B may be configured to actuate drive motor 26 when pumping mechanism 18 is magnetically coupled to driving mechanism 16. Alternatively or in addition, control circuit 26B may be configured as a safety switch to stop actuation of drive motor 26 when pumping mechanism 18 is not magnetically coupled to driving mechanism 16, or when there is a relatively weak magnetic coupling between pumping mechanism 18 and driving mechanism 16, suggesting misalignment.

A power cord plugged into an associated electrical outlet may also function as the control mechanism, in that it may simply be plugged in or unplugged in order to control the power supply. Depending on the power source, the power source itself may be disengaged or removed.

Drive motor 26 has a bearing (not shown) sufficient to tolerate axial load applied to the associated motor shaft 27. Alternatively, axial load on the motor shaft 27 may be accommodated by a separate bearing assembly (not shown) attached to driving mechanism 16 and interposed around the motor shaft between drive motor 26 and first magnetic drive member 24.

Figure 4:
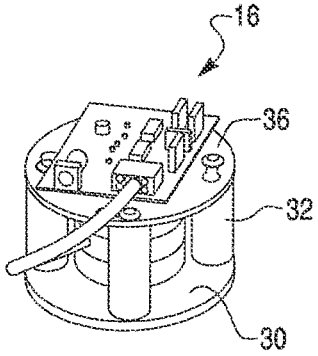
FIG. 4 is a perspective view of a driving mechanism according to the present invention.
Figure 5:
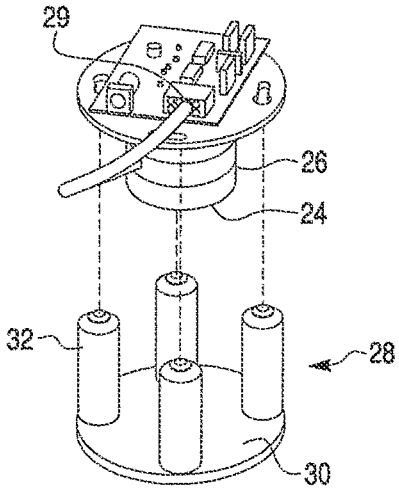
FIG. 5 is an assembly view of the driving mechanism of FIG. 4.
Figure 7:
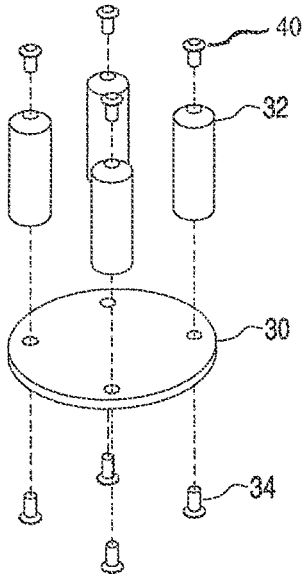
FIG. 7 is an assembly view of other components of the driving mechanism of FIG. 4.
Figure 8:
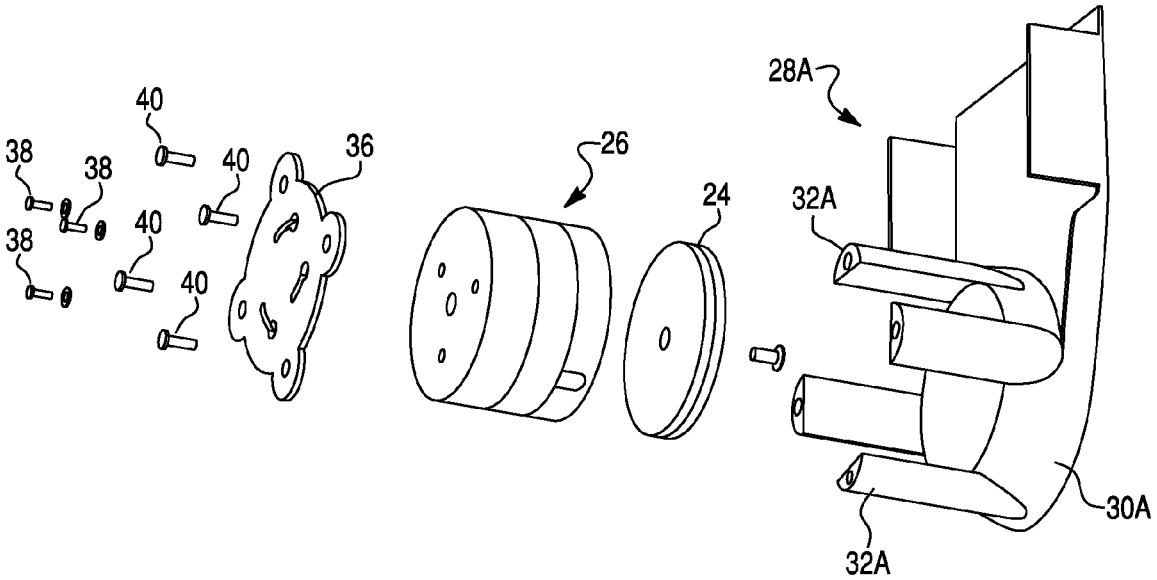
FIG. 8 is an assembly view of components of a driving mechanism according to another embodiment.

A first casing 28 is provided, which serves to support first magnetic drive member 24 and drive motor 26, as best shown in FIGS. 4 and 5. First casing 28 may include a fixation base 30 with outwardly extending motor standoffs 32. As best shown in FIGS. 5 and 7, motor standoffs 32 are about a circumference of fixation base 30, and secured thereto via fasteners 34. Alternatively, a first casing 28A may include an integrally formed base 30A and motor standoffs 32A, as best shown in FIG. 8. In either case, first casing 28 (or 28A) is preferably permanently or semi-permanently affixed to exterior surface 20 of sidewall 14, as best shown in FIG. 3, so that the means of affixing does not require openings extending through interior surface 22 of sidewall 14. Hence, basin 10 is not penetrated and there is no possibility of leakage of liquid as a result. Materials such as ABS, polycarbonate, acetal, nylon, polyethylene and non-magnetic metals are suitable for forming first casing 28 (or 28A).

Figure 6:
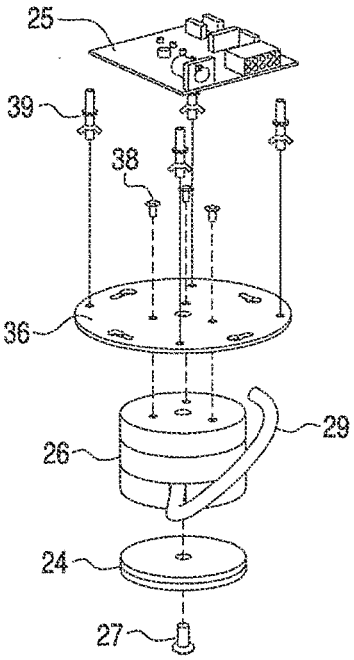
FIG. 6 is an assembly view of components of the driving mechanism of FIG. 4.

Drive motor 26 is secured to a motor bracket 36 via associated mechanical fasteners 38, as best shown in FIG. 6. Motor driver 25, if used, may also be mounted to motor bracket 36 via associated fasteners 39. Motor bracket 36, in turn, is secured to motor standoffs 32 via associated mechanical fasteners 40, thereby securing drive motor 26 and first magnetic drive member 24 to fixation base 30, as best shown in FIGS. 4-7. In this way, drive motor 26 and first magnetic drive member 24 are positioned within first casing 28. Fixation base 30 and motor standoffs 32 serve to support drive motor 26 and first magnetic drive member 24 in a position spaced from exterior surface 20 a distance sufficient to preserve magnetic force and allow first magnetic drive member 24 to spin freely, without contacting or rubbing against any other surface, as best shown in FIG. 3. The specific spacing distance is dependent upon the thickness of sidewall 14, the magnetic strength, etc. Upon application of electricity from the associated power source, drive motor 26 within first casing 28 causes first magnetic drive member 24 to spin about axis X.

As best shown in FIGS. 3 and 9-13, pumping mechanism 18 comprises a second magnetic drive member 42 drivingly coupled to a propeller 44. Note that propeller 44 shown in the figures is merely illustrative, and the present invention is not so limited. Thus, the specific configuration of the propeller may vary, and may include one or more blades.

Second magnetic drive member 42 is formed from a magnetic material, such as neodymium, and has at least one pair of magnetic poles (N) and (S). Preferably, second magnetic drive member 42 is in the form of a circular disk and has a plurality of pairs of magnetic poles (N) and (S). In the preferred embodiment of the present invention, second magnetic drive member 42 is substantially identical to first magnetic drive member 24. A steel shield (not shown) may be disposed on and cover the distal surface of second magnetic drive member 42. The shield concentrates the magnetic flux of second magnetic drive member 42 forwardly, thereby increasing the functional efficiency of the assembly.

Second magnetic drive member 42 is rotatable about axis X when pumping mechanism 18 is positioned in a predetermined location against interior surface 22 of sidewall 14 and aligned with driving mechanism 16, as shown in FIG. 3. Sidewall 14 is formed from a non-magnetic material, and separates first and second magnetic drive members 24, 42. When disposed in the predetermined position within basin 10, first and second magnetic drive members 24, 42 are magnetically coupled to each other so that propeller 44 is rotated about axis X upon actuation of drive motor 26. In this way, propeller 44 may be actuated without any shaft extending from interior surface 22 through sidewall 14.

Figure 10:
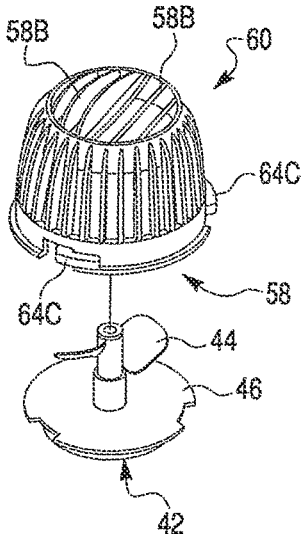
FIG. 10 is an assembly view of the pumping mechanism of FIG. 9.
Figure 11:
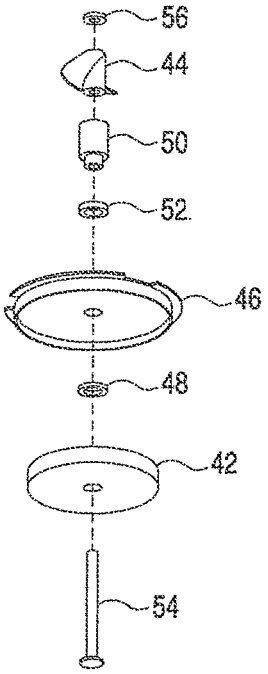
FIG. 11 is an assembly view of components of the pumping mechanism of FIG. 9.
Figure 10A:
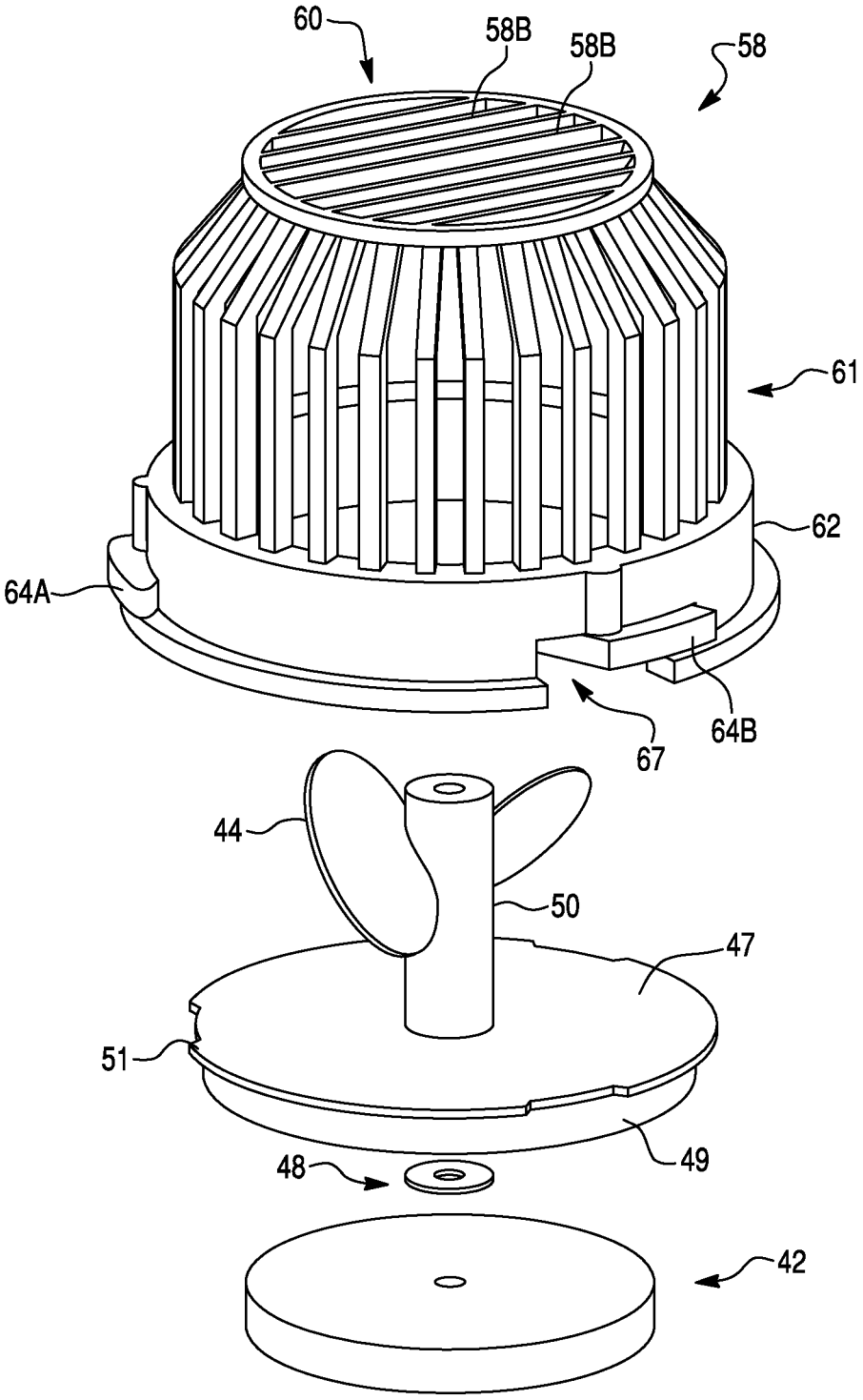
FIG. 10A is another assembly view of components of the pumping mechanism of FIG. 9.

Second magnetic drive member 42 may be partially disposed within a frame 46 having an upper plate 47 and a side wall 49 extending outwardly from undersurface thereof, as best shown in FIGS. 3, 10, 10A and 11. Side wall 49 may have a cylindrical configuration, and defines a recess for receiving second magnetic drive member 42 and permitting second magnetic drive member 42 to rotate therein. Upper plate 47 may have a circular configuration with the periphery thereof extending outwardly from side wall 49, thereby forming a flange 51 extending outwardly from side wall 49, as best shown in FIGS. 10A and 11. A washer 48 preferably separates second magnetic drive member 42 and frame 46, acting as a bearing between the two components. In addition, washer 48 minimizes wobble of the components and reduces noise during operation.

Figure 13:
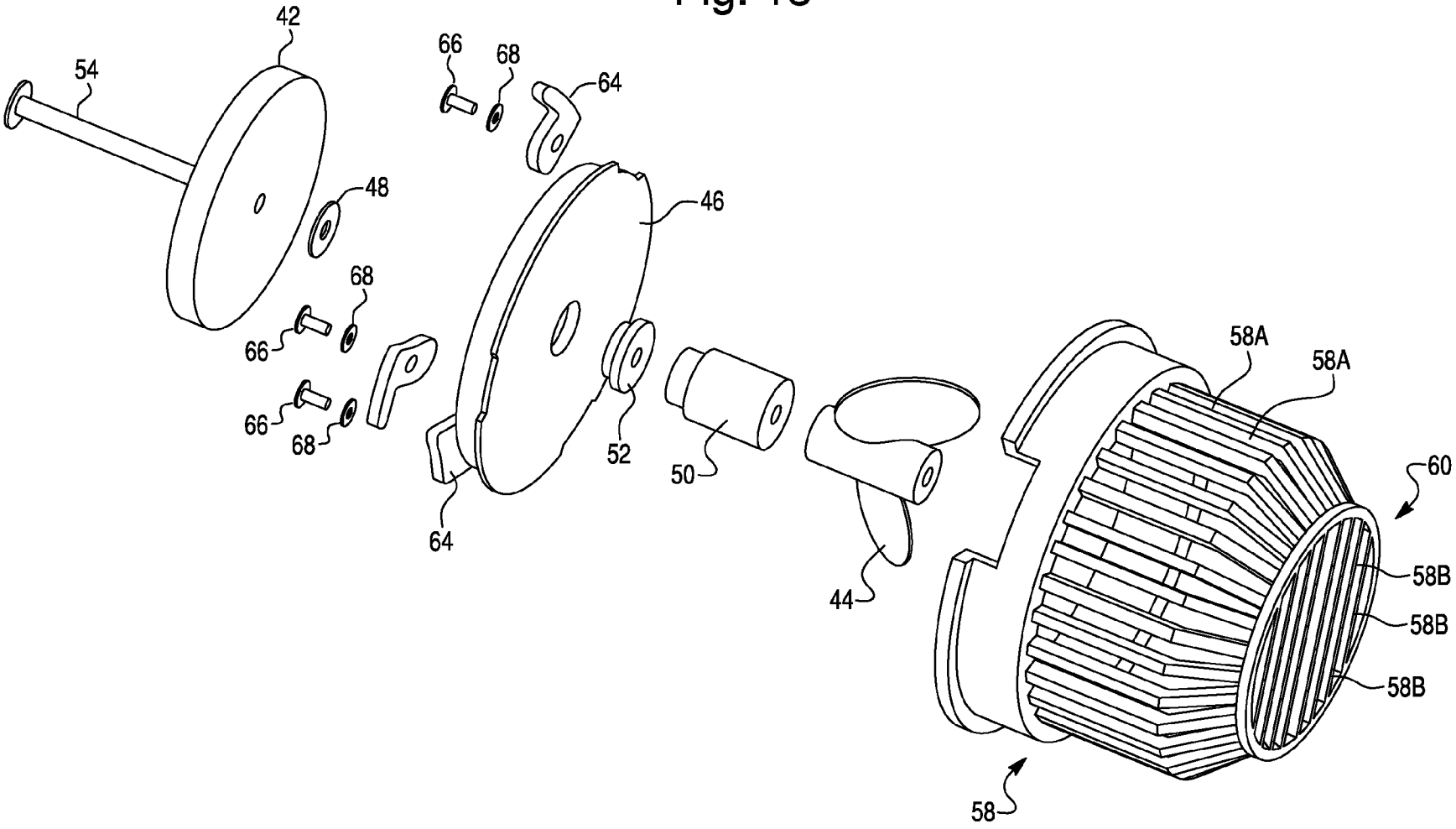
FIG. 13 is another assembly view of components of the pumping mechanism of FIG. 9.

A drive shaft 50 is disposed between frame 46 and propeller 44. Preferably, a bearing 52 is disposed between drive shaft 50 and frame 46, which bears the force of drive shaft 50, and minimizes the friction of rotation. Bearing 52 is preferably formed from ceramic, but may also be formed from some other suitably hard and smooth mating surface, such as a plastic composition, Teflon, UHMW, or metal suitable for the operating environment. A drive shaft screw 54 extends through corresponding openings in second magnetic drive member 42, frame 46, bearing 52, drive shaft 50, and propeller 44, thereby holding the torque transmission components together, as best shown in FIGS. 11, 10A and 13. A nut 56 tightens upon the distal end of drive shaft screw 54 adjacent propeller 44, thereby securing the components thereon.

Figure 11A:
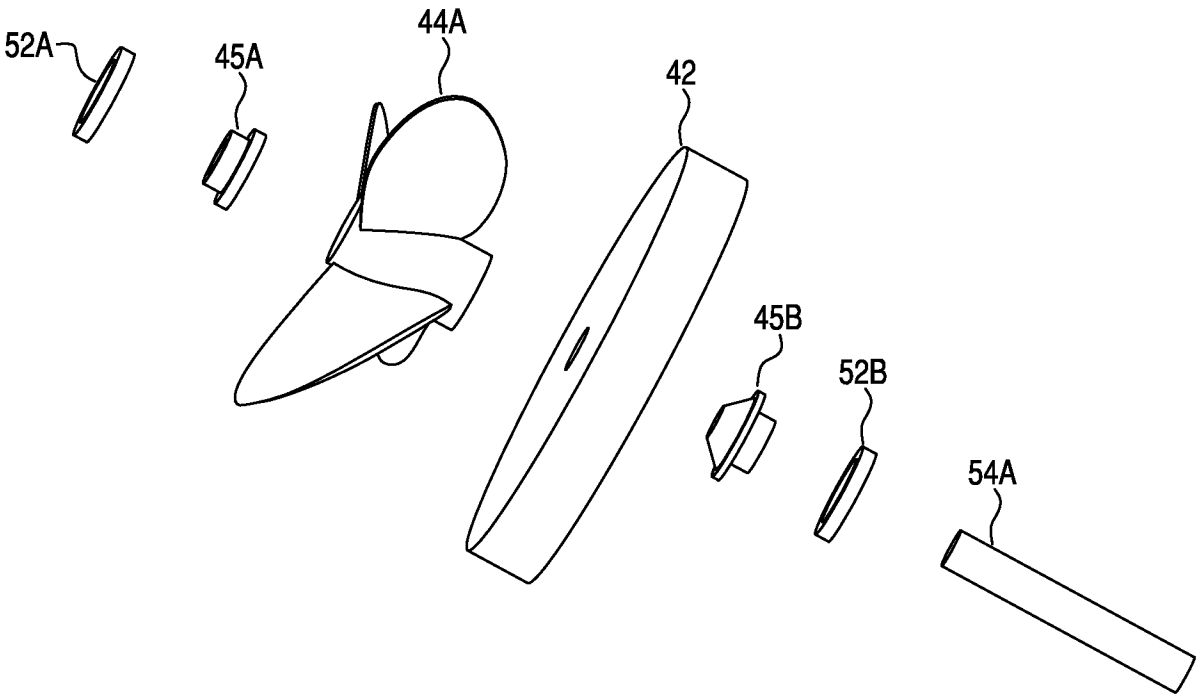
FIG. 11A is an assembly view of components of a pumping mechanism according to another embodiment.

It should be understood that the specific configuration of torque transmission components may vary depending on particular materials used, application needs, noise level considerations, and other manufacturing considerations. Moreover, the specifications for each component may vary. For example, a three blade propeller 44A may be provided which is configured such that drive shaft 50 is eliminated, as shown in FIG. 11A. Propeller 44A may be disposed adjacent second magnetic drive member 42, with a front drive shaft 45A provided at the distal end of propeller 44A, and a rear drive shaft 45B provided adjacent second magnetic drive member 42. First and second bearings 52A, 52B may be provided against each of drive shafts 45A, 45B, respectively. The torque transmission components are disposed and aligned on an assembly pin 54A, similar to drive shaft screw 54. Such a two bearing system, with bearings 52A, 52B located at opposite ends of the rotating assembly, minimizes noise level of the pump, particularly in the event pumping mechanism 18 is not properly aligned.

Pumping mechanism 18 also preferably includes a nozzle 58, which is configured to encase the torque transmission components. Nozzle 58 acts as a cage around propeller 44 in order to protect the user and technician during operation. As best shown in FIGS. 9A, 10A, 12, 12A and 13, nozzle 58 includes a distal end portion 60, a central portion 61, and a lower portion 62.

Central portion 61 may have a generally cylindrical configuration, and includes a series of slots 58A or openings therein. Slots 58A preferably extend longitudinally along nozzle 58 parallel to the axis X of rotation (shown in FIG. 3) of propeller 44 when pumping mechanism is in position within basin 10. A series of openings defined by a plurality of slats 58B are formed in distal end portion 60 of nozzle 58, as best shown in FIGS. 10, 10A and 13. Slots 58A act as a liquid intake area and the openings between slats 58B act as a liquid output area.

The configuration of nozzle 58 in combination with the use of propeller 44 provides for a radial input of the liquid to propeller 44 and axial output from propeller 44. Propeller 44 pumps a relatively large volume of liquid at a lower velocity compared to conventional impeller designs. The perceived strength of output from propeller 44 is lower than that of an impeller type design, which is focused into a high velocity jet. Hence, the low flow rate and yet high volume flow provided by propeller 44 provides a soothing massage to the feet of the user, enhancing the spa experience.

Figure 15:
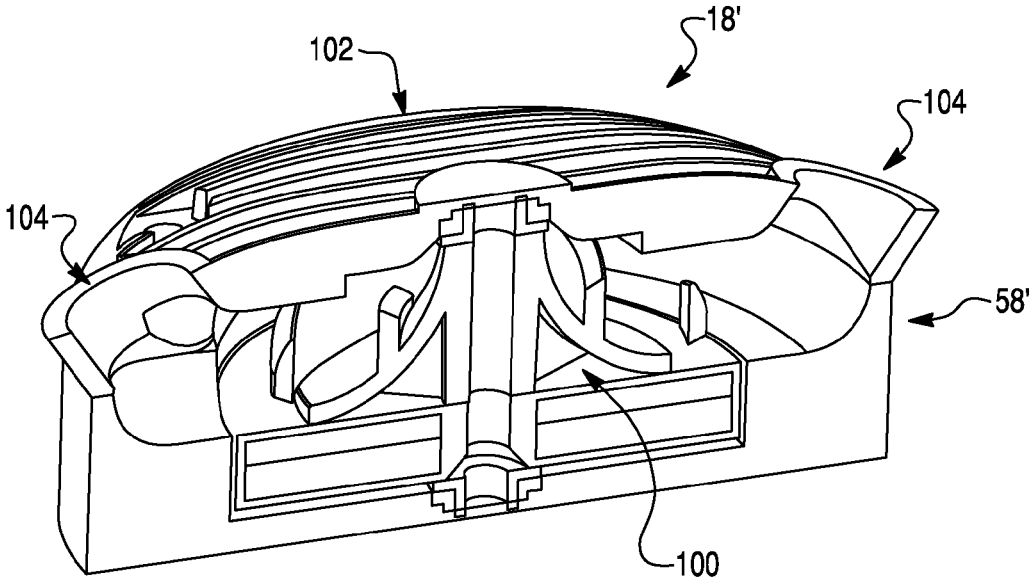
FIG. 15 is a sectional perspective view of a pumping mechanism according to another embodiment.

However, an impeller may alternatively be used instead of propeller 44, depending on the particular application and desired water circulation within basin 10. In addition, an impeller may provide a lower profile design compared to propeller 44, given an impeller does not require drive shaft 50. For example, an exemplary embodiment of a pumping mechanism 18' is shown in FIG. 15. Pumping mechanism 18' includes an impeller 100 housed within a nozzle 58'. Nozzle 58' includes an intake area 102 and output areas 104, which act as discharge vents, whereby liquid is drawn into intake area 102 via impeller 100 and discharged through output areas 104. Pumping mechanism 18' includes second magnetic drive member 42, which causes impeller 100 to spin, as described above with respect to propeller 44. The magnetic coupling provides the torque and fixation of nozzle 58' to the sidewall 14 of basin 10.

Thus, various types of mixing blades, either propeller type or impeller type, may be employed with the disclosed pumping mechanism. Moreover, the specific blade configuration, and number of blades, may vary depending on the particular application.

Slats 58B may be angularly disposed relative to the axis X of rotation, so that the flow of liquid pushed outwardly by propeller 44 is directed to desired areas within basin 10. Slats 58B may be provided at any desired angle. In addition, some slats 58B may extend outwardly at an angle substantially parallel to the axis X of rotation, while others are angularly disposed, for example at an angle of between about 30° to about 70° relative to the axis X of rotation, so that a portion of the flow of liquid propelled outwardly from nozzle 58 is directed toward the feet of the customer during operation. Thus, pumping mechanism 18 moves liquid in a direction dictated partially by the construction of nozzle 58.

In a preferred embodiment, slats 58B are angularly disposed with a portion of slats 58B directing water toward one sidewall 14 of basin 10 and another portion of slats 58B directing water toward another opposite sidewall 14 of basin 10. In this way, the liquid output from distal end portion 60 is split in two directions in a 'V form', thereby directing the liquid at both the user's feet when disposed in basin 10. This split flow design assures that each foot is adequately massaged to enhance the spa experience. Furthermore, only a single pumping assemble is thus necessary so that cost and complexity is reduced.

Figure 9:
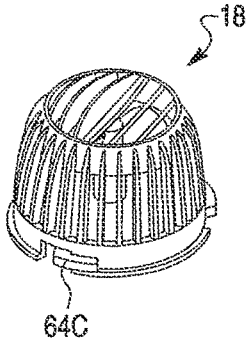
FIG. 9 is a perspective view of a pumping mechanism according to the present invention.
Figure 12:
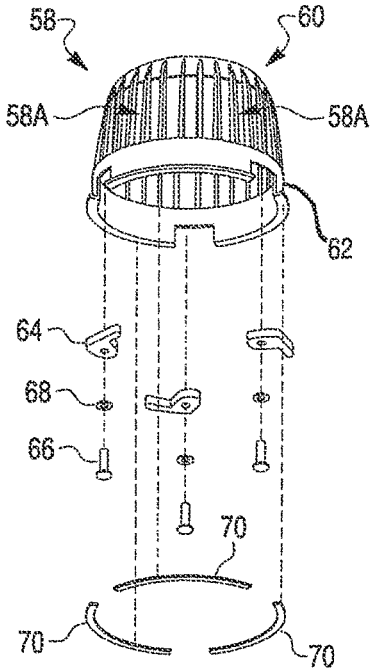
FIG. 12 is an assembly view of other components of the pumping mechanism of FIG. 9.
Figure 9A:
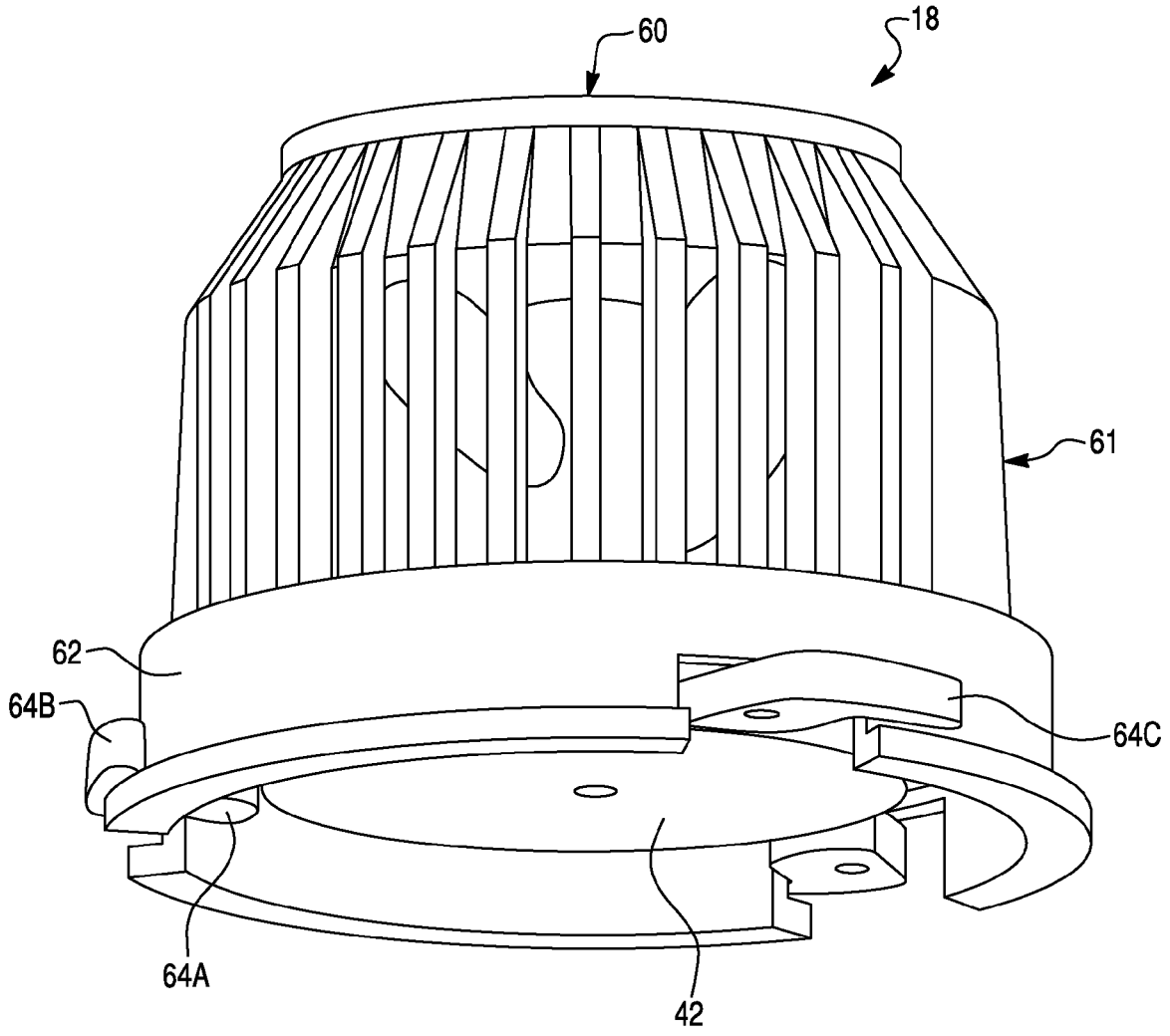
FIG. 9A is another perspective view of the pumping mechanism shown in FIG. 9.

Nozzle 58 is configured such that frame 46 is received within lower portion 62, as best shown in FIGS. 9A, 10 and 12. Upper plate 47 may be seated against an inner ring 63, which extends outwardly from an inner surface 65 of lower portion 62, as shown in FIG. 12A.

Figure 12A:
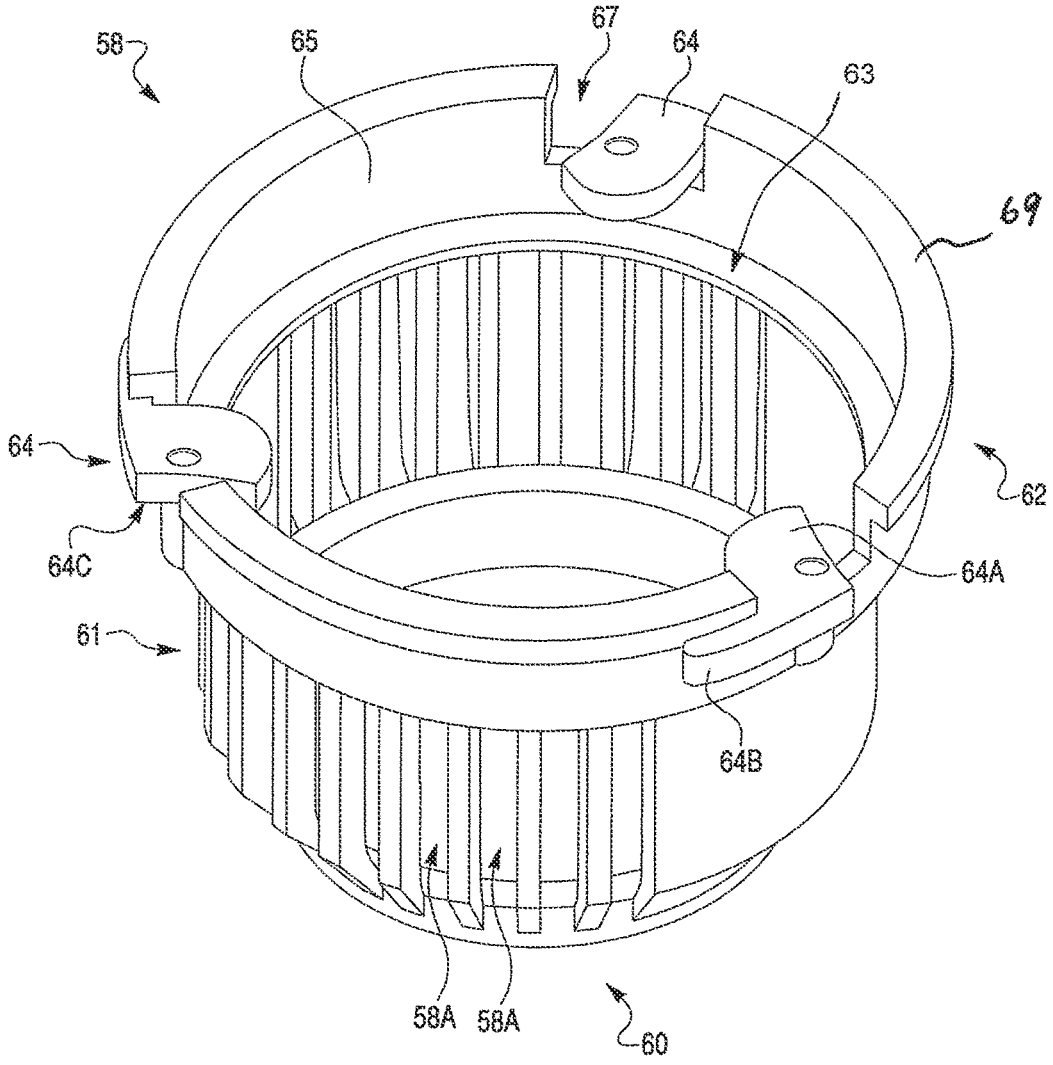
FIG. 12A is a perspective view of a nozzle according to the present invention.

One or more locking levers 64 are rotatably secured to lower portion 62 via associated fasteners 66 and washers 68, as shown in FIGS. 12 and 12A. Lower portion 62 includes one or more cutout portions 67 where locking levers 64 are disposed. Locking levers 64 include a cam portion 64A which is inwardly pivotable toward or away from inner surface 65 of lower portion 62, and a lock arm 64B extending outwardly from cam portion 64A. When frame 46 is disposed within nozzle 58 and seated against inner ring 63, cam portion 64A may be pivoted inwardly against side wall 49 and underneath flange 51, thereby releasably locking frame 46 in place within nozzle 58, as shown in FIG. 9A. Cam portion 64A may be pivoted outwardly away from side wall 49 for detaching frame 46 from nozzle 58. Preferably, cam portion 64A includes a linear edge 64C to provide sufficient clearance for flange 51 when in an open position, thereby permitting frame 46 to be easily removed from nozzle 58.

Cam portion 64A may be pivoted to an open position when a distal end of lock arm 64B is pivoted away from the exteriorly disposed surface of lower portion 62. Cam portion 64A is pivoted to a closed position when the distal end of lock arm 64B is pivoted toward and against an exteriorly disposed surface 62*a* of lower portion 62, as best shown in FIGS. 9A, 10A and 12A. Lower portion 62 may include an outer ring 69 extending outwardly from lower portion 62. Lock arm 64B may be seated above and against outer ring 69, thereby providing a friction fit between lock arm 64B and outer ring 69. Cam portion 64A is wedged against side wall 49 and flange 51. In this way, frame 46 is securely disposed within nozzle 58. However, the fit is such that a user may detach frame 46 from nozzle 58 by manually pivoting lock arms 6413 outwardly so that locking levers 64 are disposed in an open position.

Thus, lock arms 64B may be rotated to an open position in which frame 46 may be easily slid into or out of lower portion 62, and rotated to a closed position in which frame 46 is locked in place within lower portion 62 of nozzle 58, as shown in FIGS. 9 and 9A. Locking levers 64 rotate between locked and unlocked positions to secure frame 46 and thus propeller 44 inside nozzle 58 during operation.

When frame 46, propeller 44, and the other torque transmission components are locked in place within nozzle 58 so that upper plate 47 is seated against inner ring 63, second magnetic drive member 42 is spaced from interior surface 22 of sidewall 14, as best shown in FIG. 3. In this way, second magnetic drive member 42 may spin freely. Should frame 46 become separated from nozzle 58, or misaligned such that upper plate 47 is not properly seated against inner ring 63, second magnetic drive member 42 is pulled against interior surface 22 due to the magnetic force, and ceases to rotate due to friction. As such, propeller 44 ceases to rotate. In this way, the customer and technician are prevented from being harmed by a spinning propeller 44 not encaged by nozzle 58.

When locking levers 64 are pivoted to the open position and/or frame 46 becomes dislodged from lower portion 62, the clamping force between first and second magnetic drive members 24, 42 creates sufficient frictional force between second magnetic drive member 42 and interior surface 22, thereby acting as a safety shutoff. Alternatively or in addition, the increased clamping force may be detected by an associated sensor, which sends a shutoff signal to drive motor 26, and shutoff occurs.

Figure 16:
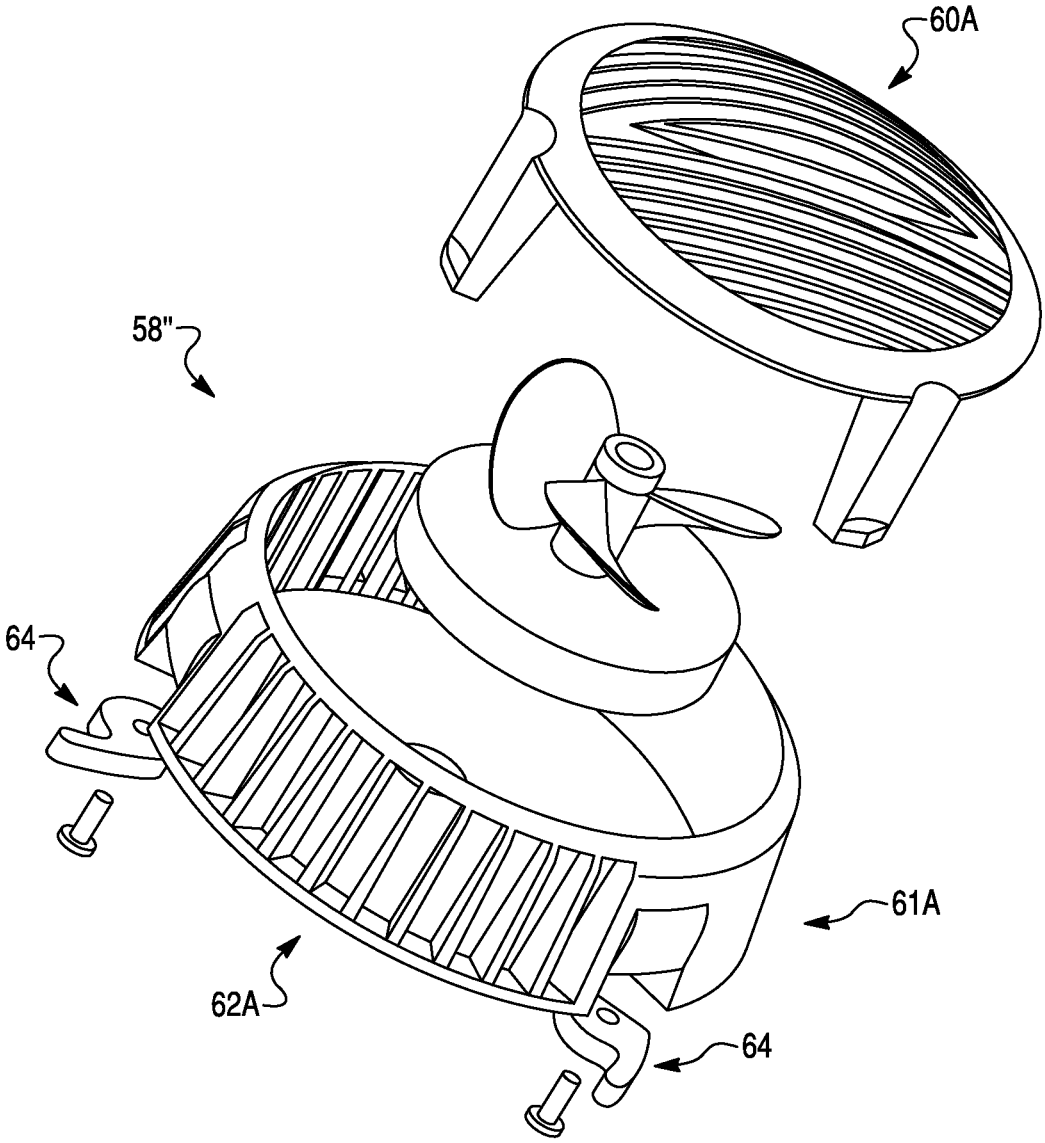
FIG. 16 is a perspective view of a nozzle according to another embodiment.

It should be understood that the specific configuration of nozzle 58 may vary depending on the particular application, configuration of basin 10, and/or configuration of the torque transmission components. For example, a nozzle 58" for housing a two bearing system, such as shown in FIG. 11A, is shown in FIG. 16. Nozzle 58" may include an end portion 60A detachably secured to a central portion 61A. A lower portion 62A is provided, to which locking levers 64 may be affixed.

In order to ensure that nozzle 58 (or nozzle 58' or nozzle 58") does not also rotate during operation of propeller 44, frictional members are provided between lower portion 62 and interior surface 22 of sidewall 14. For example, rubber pads 70 may be adhesively secured to lower portion 62, as best shown in FIG. 12.

The present invention overcomes problems associated with conventional foot spa tubs due to the modular nature of the magnetic coupling between driving mechanism 16 and pumping mechanism 18, thereby avoiding the necessity to provide holes in sidewall 14 of basin 10. Pumping mechanism 18, and specifically nozzle 58 (or nozzle 58' or nozzle 58"), is situated against interior surface 22 of sidewall 14, and driving mechanism 16 is situated against exterior surface 20 of sidewall 14, so that the axis of rotation of drive shaft 50 and the axis of rotation of motor shaft 27 are substantially coaxial. Drive motor 26 and propeller 44 are magnetically coupled to each other by first magnetic drive member 24 and second magnetic drive member 42, through sidewall 14, so as to drivingly couple drive motor 26 and propeller 44.

When drive motor 26 is activated, first magnetic drive member 24 is rotated, thereby causing second magnetic drive member 42 to rotate due to the attractive magnetic forces between opposing poles on second magnetic drive member 42 and first magnetic drive member 24. As second magnetic drive member 42 is drivingly connected to propeller 44, the rotation of drive motor 26 causes corresponding rotation of propeller 44 due to the magnetic coupling between first magnetic drive member 24 and second magnetic drive member 42. Thus, second magnetic drive member 42 may be referred to as a magnetic driven member, driven by first magnetic drive member 24.

Although basin 10 may include configured portions designed for receiving nozzle 58, such as slight indented or recessed portions, pumping mechanism 18 is preferably releasably secured to sidewall 14 only by the magnetic force generated when first and second magnetic drive members 24, 42 are magnetically coupled. Thus, such indented or recessed portions are not necessary to retain pumping mechanism 18 in the desired position within basin 10, given driving mechanism 16 and pumping mechanism 18 automatically come into coaxial alignment by virtue of the magnetic attraction provided by first and second magnetic drive members 24, 42 communicating magnetically with each other.

Configured portions of basin 10 may aid the technician in aligning and installing pumping mechanism 18 in the proper place within basin 10. Such areas within basin 10 may be identified in various manners. For example, an integrally formed support ring (either recessed or protruded from sidewall 14) may be provided against which pumping mechanism 18 is aligned and installed. Alternatively, a separate support ring may be secured to sidewall 14, such as with an adhesive or other suitable means which permanently fixes the support ring to sidewall 14. A separate support ring or positioning member may be appropriate if retrofitting an existing tub that incorporated older technology, which may or may not have holes in its sidewall, with the pumping mechanism 18 and system disclosed herein. Alternatively, the portion of sidewall 14 on which pumping mechanism 18 is installed may be marked with an alignment diagram or circle printed or painted onto sidewall 14.

Other means of aiding in the alignment and installation of pumping mechanism 18 may also be provided. For example, embedded magnets in or behind sidewall 14, separate from first and second magnetic drive members 24, 42, may be provided, which cooperate with corresponding positioning magnets in pumping mechanism 18 for aligning and removably securing pumping mechanism 18 in the desired position against sidewall 14. For example, pumping mechanism 18 may include two or more peripherally located positioning magnets, which are magnetically attracted to correspondingly positioned magnets within or behind sidewall 14. Alternatively, the corresponding positioning magnets may be provided in driving mechanism 16, which cooperate with and are magnetically attracted to positioning magnets in pumping mechanism 18 when pumping mechanism 18 is in the desired position on sidewall 14. Alternatively or in addition, positioning posts or protrusions may be provided on sidewall 14, which cooperate with correspondingly configured openings or recessed portions on pumping mechanism 18.

If desired, such alignment and fixation means, such as the embedded magnets and/or positioning posts, may hold pumping mechanism 18 in place against sidewall 14 regardless of the presence of first and second magnetic drive members 24, 42.

The magnetic attraction between first and second drive members 24, 42 should be sufficiently high so that nozzle 58 is clamped in place within basin 10 with sufficient force so that circulation of the liquid within basin 10 and/or slight contact by the user or technician (e.g. such as if the customer bumps nozzle 58 with his or her foot) will not dislodge nozzle 58. No additional fasteners are required for maintaining nozzle 58 in position within basin 10. However, the magnetic attraction should not be so great such that the technician cannot easily remove pumping mechanism 18 away from its operational position within basin 10 if desired. As such, pumping mechanism 18 is easily removed from basin 10 for maintenance or cleaning and for permitting the basin 10 to be sanitized.

For example, the net magnetic attraction may be at least 1.0 pound, preferably at least 2.5 pounds and more preferably 4.5 pounds, in order to hold nozzle 58 in position during operation of foot tub spa T. The net magnetic attraction is the magnetic attraction attributable to first and second magnetic drive members 24, 42. Thus, the size of first and second magnetic drive members 24, 42 and their magnetic strength may be reduced or increased, as needed.

Sanitization is very important in the pedicure spa industry. Because there are no holes in sidewall 14, basin 10 is leak-free and much easier to sanitize. Further, the configuration of the disclosed foot spa tub T permits for the use of a disposable sanitized liner 7 in basin 10, as shown in FIG. 2A. Liner 7 may be adapted with a valve or hole with a temporary seal to align with an associated drain of basin 10 for draining water therefrom. Alternatively, liner 7 may be adapted without any holes, whereby water is drained manually from basin 10. In either case, no other holes are required in liner 7 due to the configuration of magnetically coupled driving mechanism 16 and pumping mechanism 18. Liner 7 may be either relatively rigid or flexible and preferably fits snugly within basin 10, which supports the water filled liner 7.

Once service of a customer is complete, pumping mechanism 18 is easily separated from sidewall 14 and may be placed in a sanitizing solution. The liquid is drained from liner 7, either manually or via the associated drain in basin 10. The used liner 7 may then discarded. Sidewalls 14 of basin 10 need not contact liquid due to liner 7. A new and/or clean liner 7 is inserted into basin, and a freshly sanitized pumping mechanism 18 fitted to sidewall 14 within basin 10, thereby reducing downtime of the tub required between customers and promoting sanitary conditions.

The foregoing description of preferred embodiments of the present invention has been presented for the purpose of illustration. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. Moreover, features or components of one embodiment may be provided in another embodiment. Thus, the present invention is intended to cover all such modification and variations.

We claim:

1. A method of circulating liquid in a foot spa tub, comprising:

positioning a first casing on an exterior surface of a basin containing a liquid, the first casing comprising a first magnetic drive member rotatably coupled to a source of rotary motion;

positioning a nozzle adjacent an interior surface of the basin and in alignment with the first casing, the nozzle releasably secured to a second magnetic drive member and a blade;

allowing the first casing and the nozzle to remain in alignment as a result of a magnetic attraction force between the first and second magnetic drive members; and operating the source of rotary motion causing the first magnetic drive member to rotate, thereby causing rotation of the second magnetic drive member and of the blade;

the nozzle being releasably secured to the second magnetic drive member through a locking assembly;

the locking assembly comprising locking levers rotatably secured to the nozzle.

2. The method of claim 1, wherein the nozzle is aligned with the first casing so that the first and second drive members are coaxially aligned.

3. The method of claim 1, wherein the blade is immersed in the liquid.

4. The method of claim 1, further comprising a control circuit for controlling actuation of the source of rotary motion.

5. A method of circulating liquid in a foot spa tub claim 1, comprising:

positioning a first casing on an exterior surface of a basin containing a liquid, the first casing comprising a first magnetic drive member rotatably coupled to a source of rotary motion;

positioning a nozzle adjacent an interior surface of the basin and in alignment with the first casing, the nozzle releasably secured to a second magnetic drive member and a blade;

allowing the first casing and the nozzle to remain in alignment as a result of a magnetic attraction force between the first and second magnetic drive members; and operating the source of rotary motion causing the first magnetic drive member to rotate, thereby causing rotation of the second magnetic drive member and of the blade;

wherein the first casing is permanently fixed to the exterior surface.

6. A method of circulating liquid in a foot spa tub, comprising:

positioning a driving mechanism on an exterior surface of a basin containing a liquid, the drive mechanism comprising a first magnetic drive member;

positioning a pumping mechanism on an interior surface of the basin, the pumping mechanism comprising a second magnetic drive member connected to a blade for imparting movement to the fluid, a frame, and a nozzle releasably attached to the frame;

the frame comprising a plate portion with sidewalls extending outwardly from an undersurface thereof to define a recess, the second magnetic drive member at least partially retained within the recess;

the nozzle being releasably secured to the plate; and rotating a locking lever to detach the nozzle from the plate.

7. The method of claim 6, wherein the first magnetic drive member is connected to a drive motor for imparting rotation to the first magnetic drive member.

8. The method of claim 7, further comprising aligning the second magnetic drive member with the first magnetic drive member so that the second magnetic drive member is magnetically coupled to the first magnetic drive member.

9. The method of claim 8, further comprising operating the drive motor for imparting movement to the fluid in the basin.

10. The method of claim 6, further comprising a drive shaft connecting the blade and the second magnetic member.

11. A method of circulating liquid in a foot spa tub, comprising:

positioning a driving mechanism on an exterior surface of a basin containing a liquid, the drive mechanism comprising a first magnetic drive member; and positioning a pumping mechanism on an interior surface of the basin, the pumping mechanism comprising a second magnetic drive member connected to a blade for imparting movement to the fluid, a frame, and a nozzle releasably attached to the frame;

wherein the frame comprises a plate portion with sidewalls extending outwardly from an undersurface thereof in the direction away from the blade to define a recess, the second magnetic drive member at least partially retained within the recess.

12. The method of claim 11, wherein the nozzle is releasably secured to the plate.

13. A method of circulating liquid in a foot spa tub, comprising:

positioning a spa tub device comprising a basin and a first casing, the basin comprising an exterior surface and an interior surface designed for holding a liquid, the first casing positioned on the exterior surface of the basin, the first casing comprising a first magnetic drive member rotatably coupled to a source of rotary motion;

placing liquid in the basin;

positioning a nozzle adjacent the interior surface of the basin and in alignment with the first casing, the nozzle releasably secured to a second magnetic drive member and a blade;

placing a user's feet in the liquid; and operating the source of rotary motion causing the first magnetic drive member to rotate, thereby causing rotation of the second magnetic drive member and of the blade.

14. The method of claim 13, wherein the nozzle comprises openings for directing liquid to the user's feet.

15. The method of claim 13, further comprising deactivating the source of rotary motion and removing the user's feet.

16. The method of claim 15, further comprising emptying liquid from the basin and sanitizing the basin.

17. The method of claim 13, further comprising positioning a removable liner adjacent the interior surface of the basin.

* * * * *